United States Patent [19]

Castanier

[11] Patent Number: 4,547,006

[45] Date of Patent: Oct. 15, 1985

[54] LUGGAGE CLOSING DEVICE

[75] Inventor: Philippe Castanier, Geneuille, France

[73] Assignee: Superior S.A., Besancon, France

[21] Appl. No.: 445,948

[22] Filed: Dec. 1, 1982

Related U.S. Application Data

[63] Continuation-in-part of Ser. No. 192,502, Feb. 20, 1980, abandoned.

[30] Foreign Application Priority Data

Jun. 22, 1978 [FR] France ..... 78 20084
May 25, 1979 [FR] France ..... 79 00040

[51] Int. Cl.[4] ..... E05C 1/14

[52] U.S. Cl. ..... 292/37; 70/71; 292/41; 292/159; 292/170; 292/DIG. 37; 292/DIG. 72

[58] Field of Search ..... 292/37, 41, 99, 140, 292/158, 159, 170, 182, 335, 336.3, DIG. 47, DIG. 48, DIG. 50, DIG. 68, DIG. 72, DIG. 37; 70/67, 69, 70, 71, 74, 75, 76, 312; 16/110 R, 126; D8/306, 321; 190/115–121

[56] References Cited

U.S. PATENT DOCUMENTS

| | | | |
|---|---|---|---|
| 886,136 | 4/1908 | Kruse | 70/71 |
| 1,979,560 | 11/1934 | Levine | 292/99 |
| 2,652,909 | 9/1953 | Knell | 16/126 |
| 2,905,493 | 9/1959 | Tocchetto | 292/170 |
| 2,907,196 | 10/1959 | Duttine | 70/67 |
| 2,927,814 | 3/1960 | Reitzel | 292/335 |
| 3,055,204 | 9/1962 | Pelcin | 292/170 X |
| 3,135,105 | 6/1964 | Brody | 70/71 |
| 3,792,884 | 2/1974 | Tutikawa | 292/37 |
| 3,919,366 | 11/1975 | Lipschutz | 292/170 X |

FOREIGN PATENT DOCUMENTS

| | | | |
|---|---|---|---|
| 44657 | 9/1888 | Fed. Rep. of Germany | 292/37 |
| 2423608 | 4/1978 | France | 70/69 |
| 246089 | 1/1926 | United Kingdom | 70/71 |

*Primary Examiner*—Gary L. Smith
*Assistant Examiner*—Russell W. Illich

[57] ABSTRACT

A device for closing a piece of luggage comprising two parts connected by a hinge comprises an elongate case extending along a side of one part opposite the hinge and an elongate keeper extending along a side of the other part opposite the hinge. The case has spaced apertures to receive spaced hook-like hasps of the keeper and contains closing mechanism for releasably engaging the hasps to retain them in the apertures. In one form, the closing mechanism comprises an elongate member extending longitudinally in the case with detent portions to engage the hasps and a central push-button having a cam to engage the elongate member to move it longitudinally to release the hasps when the push-button is pushed in. In another form the closing mechanism comprises two elongate members extending in opposite directions from a central push-button having a cam for moving the elongate members in opposite directions to disengage the hasps.

11 Claims, 14 Drawing Figures

LUGGAGE CLOSING DEVICE

REFERENCE TO PRIOR APPLICATION

This application is a Continuation-in-Part of application Ser. No. 192,502, filed Feb. 20, 1980 now abandoned; which claims priority of French application No. 78 20084 filed June 22, 1978 and PCT EP79/00040 filed May 25, 1979.

FIELD OF INVENTION

The invention relates to a device for closing a piece of luggage comprising two parts connected by a hinge, one of the parts being a bottom and the other a cover. The closing device comprises a keeper extending along a side of one luggage part opposite the hinge and having a plurality of spaced hasps; and an elongage case extending along a side of the other luggage part opposite the hinge and having apertures to receive the hasps of the keeper and containing push-button controlled mechanism for releasably engaging the hasps of the keeper to retain them in the apertures.

BACKGROUND OF THE INVENTION

Most luggage is provided either with quick action slide fasteners when the luggage is flexible or with several locks spaced along the frame when the luggage is rigid.

Except on expensive luggage, locks do not properly withstand a prolonged use due to excessive strains to which they are subjected. Usually, there is a single central lock with two lateral folding hooks disposed on either side of, and equally spaced from, the central lock. However, these accessory fastening devices cannot be locked and if they yield because the luggage is overfilled, or for any other cause, the cover frame is liable to undergo a distortion so that the luggage gaps open.

Among known devices, those disclosed in the three patents summarized hereinafter may be cited.

German Pat. No. 1,902,360 to Schmale describes a closing device comprising a closing member (38) provided with lateral apertures (37) and an angle-bar (35) with closing hooks (36) provided with a shoulder and a bevelled face, but this device does not comprise a single and central opening and locking control system controlling the hasp assembly.

U.S. Pat. No. 1,455,069 to Launder describes a lock formed from a pair of tubes (1, 3) sliding in each other and responsive to a spring (9). Each one of the tubes comprises apertures (2, 12) adapted to receive closing hooks (8, 13). In such a lock, the risk of jamming two concentric tubes slidably fitted in each other is rather substantial and it is necessary to provide a relatively strong spring leading to a considerable opening pressure.

British Pat. No. 556,115 to Drescher and Kiefer relates to a lady's handbag clasp in which a finger (14) provided with an oblique surface (15) acts only upon the lock member, but its action must be conjugated with a tractive effort exerted on the lower edge (6) of the lock frame (1), hence the necessity of using both hands for opening the lock.

SUMMARY OF THE INVENTION

It is an object of the present invention to provide a closing device which is easily adaptable to the majority of luggage and which reinforces the rigidity of the cover by providing several locking points rendered operative by the actuation of a single mechanism.

In accordance with the present invention, a device for closing a piece of luggage comprising two parts connected by a hinge, one of the parts being a bottom and the other a cover, comprising an elongate case extending along a side of one luggage part opposite the hinge and an elongate keeper extending along a side of the other luggage part opposite the hinge and facing the case. The keeper has a plurality of spaced hook-like hasps projecting toward the case while the case has a like plurality of apertures to receive the hasps and contains a closing mechanism operable by a single central push-button for releasably engaging the hasps to retain them in the apertures and thereby securing the luggage closed. In a preferred embodiment of the invention, the case comprises a pair of parallel flat plates and means for maintaining the relative spacing between the plates, one of the plates having spaced apertures positioned to receive the hasps of the keeper.

An essential advantage of the closing device in accordance with the present invention is that the keeper extending along a side of one luggage part and the case extending along a side of the other luggage part add to the stiffness of the luggage parts and distributes the forces holding the luggage closed while being controlled by a central push-button which can be provided with a lock.

BRIEF DESCRIPTION OF DRAWINGS

Other advantages will appear from the following description of preferred embodiments of the invention illustrated by way of non-limiting example in the drawings in which.

DESCRIPTION OF PREFERRED EMBODIMENTS

Figures 1, 1A:
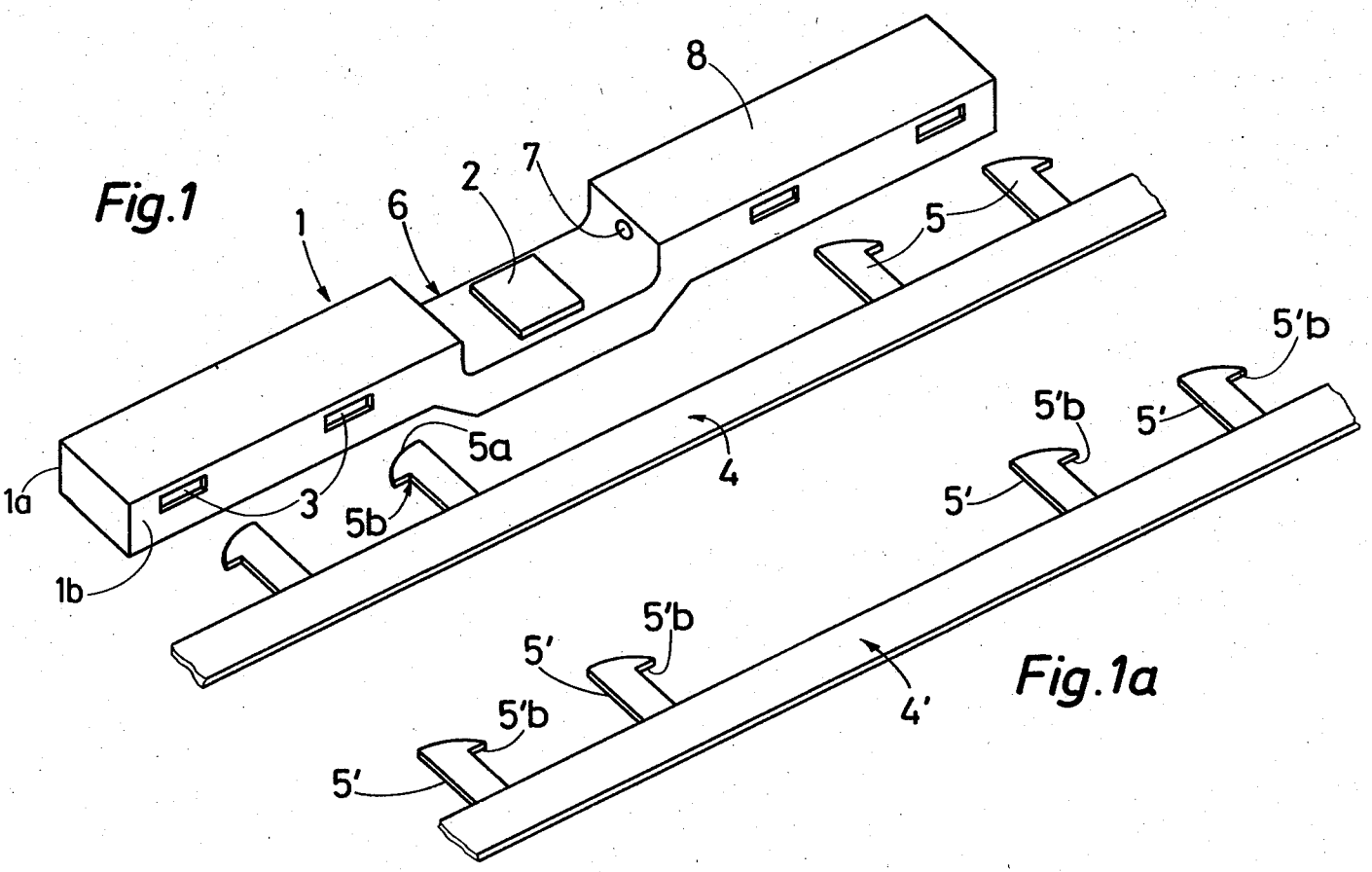
FIG. 1 is a schematic perspective view of a luggage closing device in accordance with the invention comprising a keeper on one luggage part and an elongate case containing locking mechanism on the other.
FIG. 1*a* is a perspective view illustrating a modification of the keeper.

As illustrated in FIG. 1, a luggage closing device in accordance with the invention comprises an elongate case 1 extending along a side of one luggage part opposite the hinge and enclosing mechanism of which only the control button 2 is visible. The case comprises two parallel sides 1*a* and 1*b* in the latter of which there are apertures 3 disposed at spaced intervals on either side of the push-button 2. The device also comprises a keeper 4 provided with hook-like hasps 5 which are positioned to register with the apertures 3 of the case 1. The case 1 and keeper 4 are secured respectively to the luggage shells (not shown) connected by a hinge opposite the closing device. These two component portions of the closing device have a length consistent with that of the luggage and through their inherent rigidity help to improve the rigidity of the shells or of the frame inside which they are fixed by known means for example rivets, screws, welding, etc. The case 1 and keeper 4 have a length at least half that of the luggage and preferably extend substantially the full length of the luggage. There are preferably at least four hasps 5 on the keeper 4, the hasps being spaced symmetrically with respect to the central push-button 2.

The case 1 is provided with a notch or recess 6 to receive a folding handle for carrying the luggage. Pivot points 7 of the handle are located on the sidewalls of this notch. The strength of the pivot points 7 is due to the fact that the top face 8 of the case 1 provides a high tearing strength, the luggage weight being spread over a substantial area of its periphery.

The hasps 5 distributed along the length of the keeper 4 and positioned to register with the apertures 3 of the case 1 have bevelled ends 5*a* to facilitate their introduction into the apertures. The hasps comprise shoulders 5*b* engageable by closing mechanism contained in the case 1 to retain the hasps in the apertures of the case 1 and thereby secure the luggage in closed condition.

Figure 2:
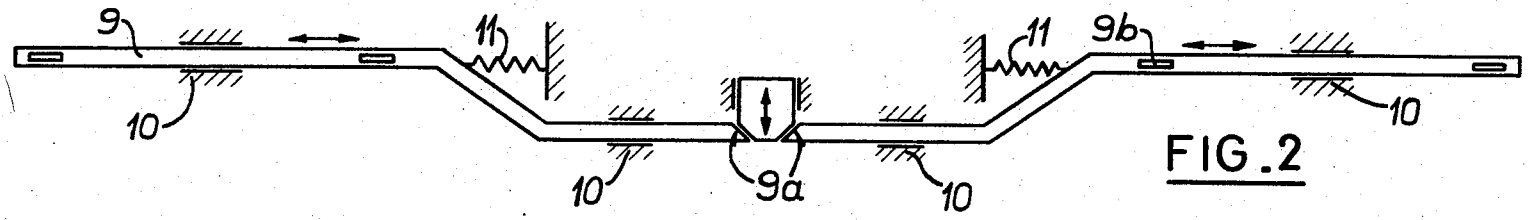
FIG. 2 is a schematic side elevation illustrating one form of the locking mechanism.

FIG. 2 illustrates the closing mechanism in the case 1 as comprising a pair of bent rods 9 sliding in bearings 10 in the case to facilitate their linear movement controlled by the push-button 2 suitably provided with a lock cylinder locked by a key. Substantially in front of each aperture 3 of the case 1, the rods 9 comprise ports 9*b* through which the hasps 5 of keeper 4 are adapted to penetrate.

The push-button 2 is tapered at its inner end to provide cam surfaces engaging end faces 9*a* of the rods 9, the latter being bevelled at such contact points so that pressure exerted on the push-button 2 produces a longitudinal movement of each rod 9 in the bearings 10 to disengage the ports 9*b* from the hasps 5 of the keeper 4. Means are provided for restoring the rods 9 to their initial positions, such means being shown as springs 11 attached at one end of the case 1 and at the other end to the rods 9 respectively so that the traction effort is exerted parallel to the axis of the rods.

When the hasps 5 of the keeper 4 are inserted in the apertures 3 of the case 1, the bevelled ends 5*a* of the hasps engage ends of the ports 9*b* of the rods 9 to move the rods outwardly from the push-button 2 against the resistance of the springs 11. When the hasps are fully inserted, the springs 11 move the rods 9 inwardly so that edges of the ports 9*b* engage the shoulders 5*b* of the respective hasps 5 to retain the hasps in the apertures and thereby hold the luggage closed. When it is desired to open the luggage, the push-button 2 is pushed inwardly and by means of its tapered inner end pushes the rods 9 outwardly so as to disengage the shoulders 5*b* of the hasps and thereby release the keeper.

As will be seen in FIG. 2, inner end portions of the rods 9 are offset from outer portions of the rods so as to pass under the recess 6 provided for the handle.

Figure 3:
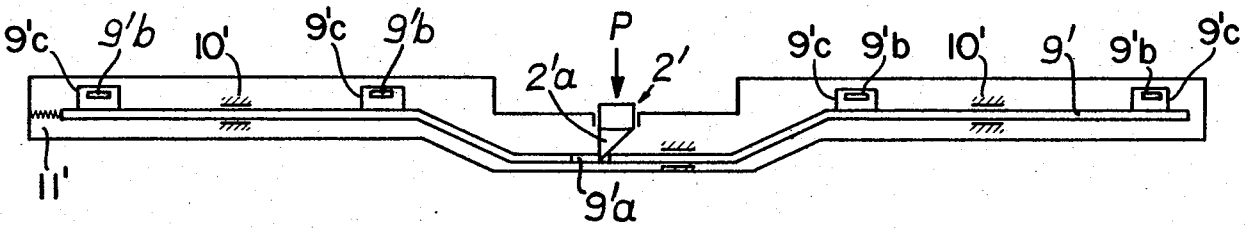
FIG. 3 is a schematic side elevation illustrating another form of the locking mechanism.

FIG. 3 illustrates another embodiment of the closing mechanism located inside the case 1 wherein the two rods 9 of the embodiment of FIG. 2 are replaced by a rod 9' which is a unitary member in which an elongated aperture 9'*a* is formed in front of the push-button 2'. The rod 9' is slidable in bearings 10' in the case and carries lugs 9'*c* located in front of each aperture 3 of the case 1 and having ports 9'*b* through which hasps 5' of a keeper 4' as shown in FIG. 1*a* are adapted to penetrate.

The end 2'*a* of the push-button 2' constitutes an isosceles rectangular triangle of which the hypotenuse is in frictional engagement with one wall of the aperture 9'*a* so that pressure P exerted on the push-button 2' moves the rod 9' and thereby the lugs 9'*c* in which apertures 9*b* are formed so as to release the hasps 5'. Since the lugs 9'*c* all move in the same direction, the shoulders 9*b* of the hasps 5' of the keeper 4' all face in the same direction as shown in FIG. 1*a*. A spring 11*a* acting between the rod 9' and the case biases the rod 9' in the opposite direction.

Figure 4:
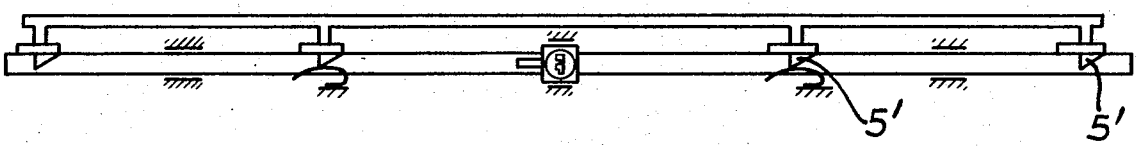
FIG. 4 is a top plan view of the mechanism shown in FIG. 3.
Figure 5:
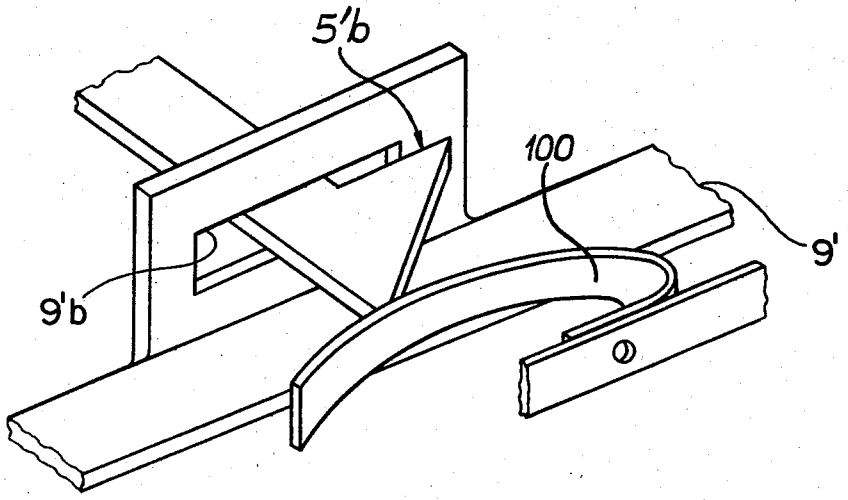
FIG. 5 is a schematic perspective view showing on a larger scale one of the hasp ejection devices shown in FIG. 4.
Figure 8:
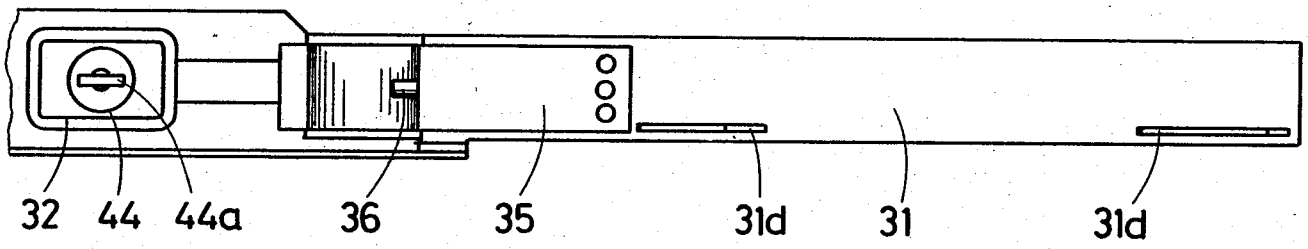
FIG. 8 is a partial top plan view of the case of another embodiment of the invention.

In order to facilitate the ejection of hasps 5' from apertures 3 of the case 1, a spring blade 100 is secured to the case wall across from each aperture 3 as illustrated in FIGS. 4 and 5. This spring blade 100 is compressed when the luggage is closed and exerts pressure against the ends of the hasps to eject the hasps from the aperture when the movement of rod 9' by the push-button 2' causes the apertures 9'*b* to register with apertures 3 of the case and thereby release the shoulders 9'*b* of the hasps.

Figure 6:
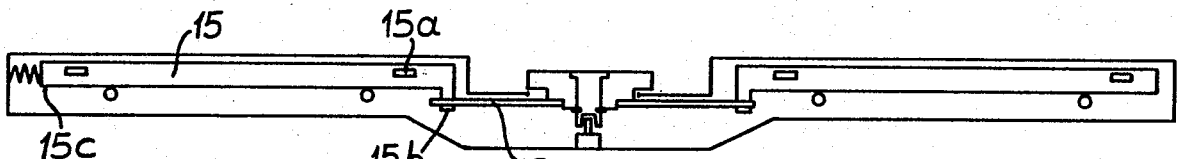
FIG. 6 is a schematic side elevation of another embodiment of the locking mechanism.
Figure 7:
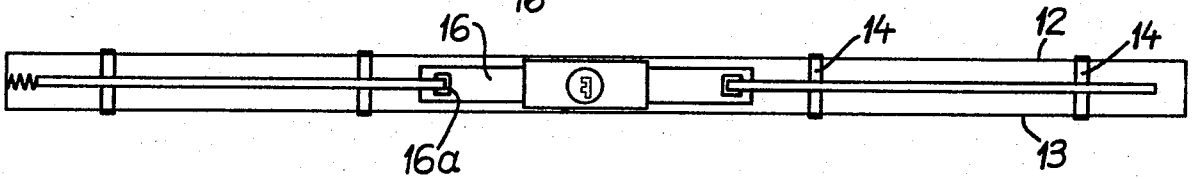
FIG. 7 is a top plan view of the embodiment shown in FIG. 6.

FIGS. 6 and 7 illustrate another modified form of the closing mechanism located inside the case 1. The case 1 consists essentially of a pair of flat plates 12, 13 of which one is provided with apertures to receive hasps 5 of a keeper 4. The relative spacing between the plates is maintained by bridge members 14 acting as support means for rods 15 formed with openings 15*a* adapted to be engaged by hasps 5 of the keeper. One end 15*b* of each rod 15 is bent and penetrates into a corresponding receiving orifice of a plate 16. The other end 15*c* is engaged by a compression spring urging the complete mechanism to locking position after the hasps of the keeper have been introduced into the openings 15*a*.

Figure 7A:
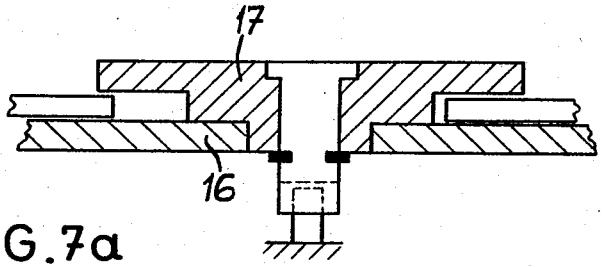
FIGS. 7*a* and 7*b* are enlarged sectional views showing details of the mechanism of FIG. 6.
Figure 7B:
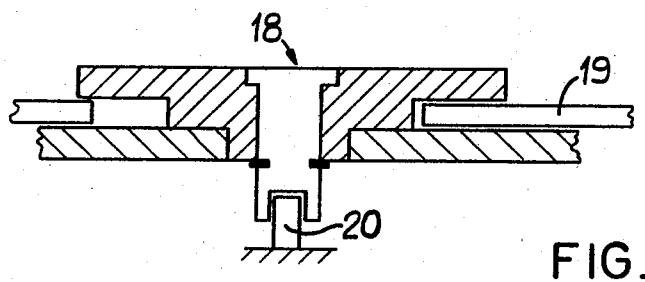

The plate 16 is suspended at its middle by a double square 17 forming a control button which is slidable in a slide 19 fixed on the side of the case 1 constituting an element of the periphery of the luggage. The push-button 17 is provided with a lock cylinder 18 provided at its inner end with a transverse slot engageable with a fixed pin 20. When the locking cylinder is in the position shown in FIG. 7*a*, the push-button 17 is movable to move plate 16 and rods 15 to the left to release the hasps. When the locking cylinder is in the position shown in FIG. 7*b*, the pin 20 holds the lock cylinder and hence the push-button 17 in locking position. This type of cylinder, currently used for example for automobile doors, constitutes a low-cost safety lock utilizing multiple-combination keys. It is also possible to use digital or letter combination locks.

Another embodiment of the invention comprising an elongate case 31 is illustrated in FIGS. 8 to 11 which show only slightly more than half of the case and enclosed mechanism, the other half being symmetrical with that shown. The case has a top 31*a* opposite parallel sides 31*b* and a bottom 31*c*. The top 31*a* and sides 31*b* are preferably formed integrally as a molding of high strength plastic material. The bottom 31*c* can likewise be molded of plastic and is formed as a separate piece which snaps into place to close the close.

Figure 9:
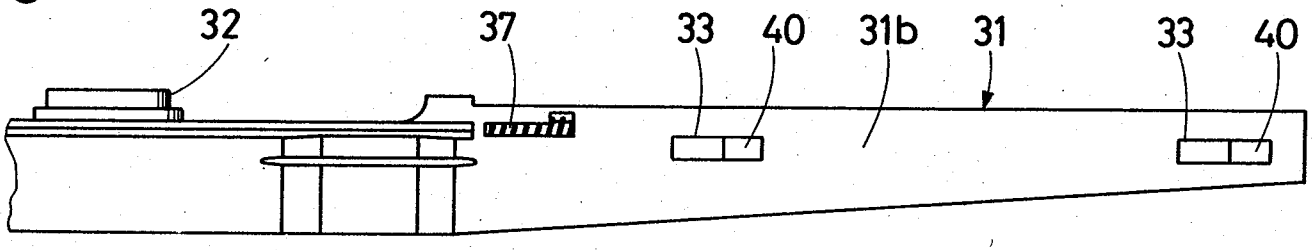
FIG. 9 is a side elevation of the case shown in FIG. 8.

The case 31 is provided at its center with an opening to receive a push-button 32 for operating latch mechanism contained in the case. One side of the case is provided with spaced apertures 33 to receive hasps 5 of a keeper 4 of the kind shown in FIG. 1. By way of example the case has four such apertures of which two are seen in FIG. 9.

The case 31 is also provided with a pair of recesses 34 to receive opposite ends of a U-shaped carrying handle (not shown). These recesses are reinforced by metal plates 35 secured to the plastic molding of the case. The handle is pivotally retained in the recesses 34 by spring pressed pivot pins 36 which are biased by spring 37 to the position shown in FIG. 10 in which the pins engage aligned holes provided in end portions of the handle. The pins 36 are retractable to release the handle.

The case 31 contains latching mechanism which is shown as comprising two elongate members 40 extending longitudinally in the case in opposite directions from the central push-button 32. Each of the members 40 comprises a heat metal plate which is flat and parallel to the side walls of the casing except for a flange 40*a* which is bent at right angles so as to be parallel to the top of the casing. The elongate member 40 is guided for a longitudinal movement in the casing by tab portions 40*b* which are slidable in slots 31*d* in the top 31*a* of the case.

Figure 11:
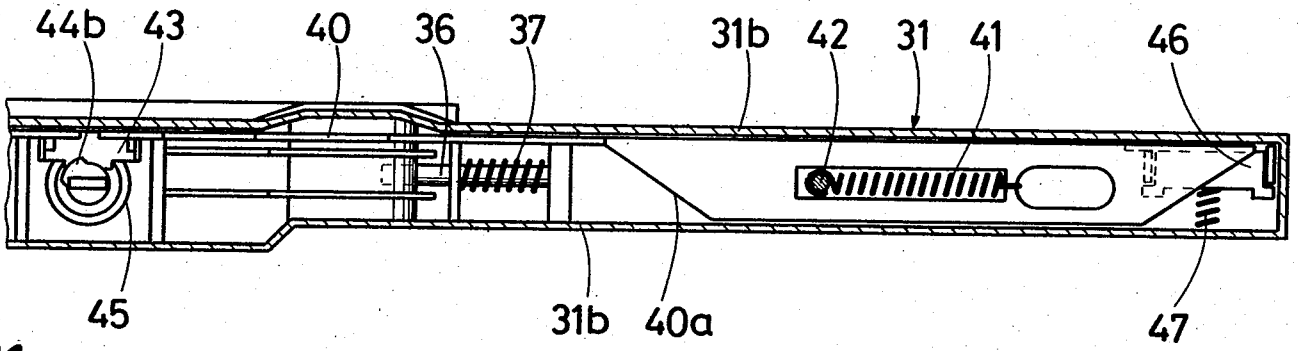
FIG. 11 is a bottom view with the bottom of the case removed.

The flat plate portion of the elongate member 40 lies against the inside of the sidewall 31*b* having the apertures 33 and has openings 40*c* at locations corresponding to the apertures 33. The member 40 is biased by a tension spring 41 to a position as illustrated in FIG. 9 in which detent portions of the member 40 partially close the apertures 33 so as to engage shoulders 5*b* of hasps 5 inserted into the apertures. The spring 41 acts between an integral pin 42 provided in the casing and a transverse portion of the flange 40*a* of member 40 as illustrated in FIG. 11.

Figure 10:
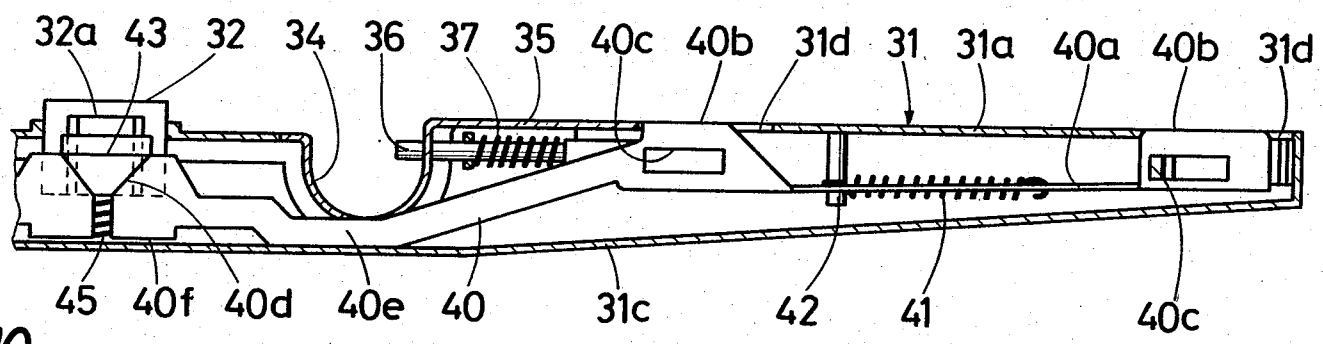
FIG. 10 is a side elevation with one side of the case removed to show internal closing mechanism.

The members 40 are movable longitudinally in a direction to release the hasps by a cam 43 on the push-button 32. As seen in FIG. 10, the cam 43 has a wedge-shaped portion engaging cam-follower portions 40*d* of the members 40. The cam 43 is slidable on the push-button 32 and is controlled by a lock cylinder 44 having a keyhole 44*a* and spaced lugs 44*b* of which one is visible in FIG. 11. When the lock cylinder is in unlocked position, the lugs 44*b* engage the cam 43 so that it is constrained to move with the push-button 32 when the push button is depressed and engages cam follower portions 40*d* of the members 40 to move the members 40 longitudinally outwardly to release the hasps of the keeper 4. When the lock cylinder is in locked position, the lugs 44*b* are disengaged from the cam 43 so that the cam is not move downwardly when the push-button 32 is depressed. Hence the hasps are not released. The push-button 32 is provided with a recess 32*a* above the cam 43 to permit downward movement of the push-button relative to the cam when the lock cylinder is in locked position. A light coil spring 45 acts between the bottom of the case and the push-button 32 to hold the push-button normally in its upper position.

As seen in FIG. 10, inner end portions 40*e* of the members 40 are offset downwardly so as to pass under the recesses 34 for the handle. At the inner ends of the members 40, there are downwardly extending tabs 40*f* engageable with the bottom of the case to provide a sliding support for the inner ends of the members 40 when the cam 43 is moved inwardly by the push-button 32.

Inwardly of at least one aperture 33 on each side of the push-button 32, a small block 46 is slidably mounted inside the case and is pressed toward the aperture 33 by a spring 47. When the hasps are inserted in the apertures 33, the blocks 46 are depressed against the action of their springs 47. When the hasps are released by longitudinal outward movement of the members 40, the blocks 46 by the action of the springs 47 press the hasps out of the apertures thereby expediting release of the keeper from the case.

In another modified embodiment of the closing mechanism, the latter consists of a pair of slidably interfitting tubes, preferably of square or rectangular cross-section. One end of the outer tube is provided with an abutment member provided with an inner spring reacting against said member and against the corresponding end of the inner tube.

The end opposite the outer tube is provided with a push-button engaging the inner tube in order to bring into mutual alignment the hasp-receiving apertures formed in parallel and juxtaposed faces of these two tubes.

The push-button is provided with a cylinder device adapted to lock the mechanism when the luggage is closed.

The luggage handle is fixed by means of a pair of straps surrounding the outer tube.

The above-described closing device constitutes a unitary structure adapted to be manufactured in a few standardised dimensions to permit the fitting thereof to conventional luggage.

The case 1 and keeper 4 are secured inside the luggage and no part thereof projects to the outside. The simplicity of the locking mechanism ensures a long-lasting efficiency. The luggage is closed by simply exerting a pressure sufficient to bring the two shells together, without it being necessary to confirm the snap engagement of the hasps through any accessory manoeuver.

What I claim is:

1. A piece of luggage comprising two parts connected by a hinge, one of said parts being a bottom and the other a cover, and a device for closing said piece of luggage, said closing device comprising an elongate case extending along a side of one luggage part opposite the hinge and an elongate keeper extending along a side of the other luggage part opposite the hinge and facing said case, said keeper having a plurality of spaced hasps projecting toward said case, and said case comprising a pair of parallel flat plates and means for maintaining the relative spacing between said plates, one of said plates having spaced apertures positioned to receive said hasps, and closing means in said case comprising latch means for releasably engaging said hasps to retain them in said apertures, spring means biasing said latch means to a hasp-retaining position and central manually operable operating means for moving said latch means to release said hasps, said operating means comprising a push button having cam means engageable with said latch means to move the same when said button is depressed, said cam means comprising a cam slidably mounted on said push button and said push button comprising locking means which in one condition secures said cam to said push button for actuation of said latch means when said push button is depressed and in another condition releases said cam from said push button so that said latch means is not actuated when said push button is depressed.

2. A piece of luggage according to claim 1, in which said latch means comprises an elongate member extending longitudinally inside said case and having detent portions engageable with said hasps when inserted in said aperture, and in which said cam has a cam surface engageable with said elongate member to move said elongate member longitudinally to disengage said detent portions from said hasps when said push button is pushed in.

3. A piece luggage according to claim 1, in which said latch means comprises two elongate members extending longitudinally inside said case in opposite directions from the center of said case, said members having detent portions engageable with said hasps when inserted in said apertures, and in which said cam has cam surfaces engageable with said elongate members to move said elongate members longitudinally in opposite directions to disengage said hasps when said push button is pushed in.

4. A piece of luggage according to claim 1, in which one edge of the case constitutes an element of the periphery of the respective luggage part and is recessed to receive a U-shaped carrying handle, and in which said case is provided with means for pivotally retaining said handle.

5. A piece of luggage according to claim 4, in which said latch means comprises a pair of elongate members extending longitudinally in said case and having detent portions engageable with said hasps when inserted in said apertures and movable longitudinally to release said hasps, adjacent end portions of said elongate members being offset to pass under the recessing for said carrying handles.

6. A piece of luggage comprising two parts connected by a hinge, one of said parts being a bottom and the other a cover, and a device for closing said piece of luggage, said closing device comprising an elongate case extending along a side of one luggage part opposite the hinge and an elongate keeper extending along a side of the other luggage part opposite the hinge and facing said case, said keeper having a plurality of spaced hasps projecting toward said case and said case having in a side facing said keeper a like plurality of apertures to receive said hasps, and closing means in said case comprising elongate latch means movable longitudinally in said case and having detent portions releasably engageable with said hasps to retain said hasps in said apertures, means biasing said latch means to hasp-retaining position and central manually operable operating means at a mid-point of said case for moving said latch means to release said hasps, said operating means comprising a push button having cam means engageable with said latch means to move said latch means longitudinally when said push button is depressed, said cam means comprising a cam slidably mounted on said push button and locking means which in one condition secures said cam to said push button for actuation of said latch means when said push button is depressed and in another condition releases said cam from said push button so that said latch means is not actuated when said push button is depressed.

7. A luggage closing device according to claim 6, in which said latch means comprises a pair of elongate members extending longitudinally in said case in opposite directions from said operating means, said elongate members having adjacent end portions engageable by said cam means to move said elongate members longitudinally in opposite directions when said push button is depressed.

8. A piece of luggage according to claim 6, in which a central portion of said case is recessed to receive opposite ends of a U-shaped carrying handle and in which a central portion of said latch means is offset to pass under said recessed portion of said case.

9. A piece of luggage according to claim 8, in which means for retaining said handle comprises spring-pressed plungers in said case engaging aligned holes in opposite end portions of said handle.

10. A piece of luggage according to claim 6, in which there are at least four hasps on said keeper, said hasps being disposed symmetrically with reference to said operating means.

11. A piece of luggage closing device according to claim 6, in which said case and said keeper extend at least half the length of said piece of luggage.

* * * * *